US011458511B2

(12) United States Patent
Kawamori et al.

(10) Patent No.: US 11,458,511 B2
(45) Date of Patent: Oct. 4, 2022

(54) CLEANING APPARATUS AND CLEANING METHOD

(71) Applicant: SUGINO MACHINE LIMITED, Uozu (JP)

(72) Inventors: Yoshiteru Kawamori, Uozu (JP); Toyoaki Mitsue, Uozu (JP)

(73) Assignee: SUGINO MACHINE LIMITED, Uozu (JP)

( * ) Notice: Subject to any disclaimer, the term of this patent is extended or adjusted under 35 U.S.C. 154(b) by 331 days.

(21) Appl. No.: 15/931,882

(22) Filed: May 14, 2020

(65) Prior Publication Data

US 2021/0001379 A1 Jan. 7, 2021

(30) Foreign Application Priority Data

Jul. 5, 2019 (JP) ..... JP2019-126289
Aug. 2, 2019 (JP) ..... JP2019-143283

(51) Int. Cl.
*B08B 3/02* (2006.01)
*B08B 3/04* (2006.01)
(Continued)

(52) U.S. Cl.
CPC ..... *B08B 3/024* (2013.01); *B08B 3/041* (2013.01); *F26B 5/00* (2013.01); *F26B 25/003* (2013.01); *B08B 5/023* (2013.01)

(58) Field of Classification Search
CPC ..... B08B 3/024; B08B 3/041; B08B 5/023; F26B 5/00; F26B 25/003
(Continued)

(56) References Cited

U.S. PATENT DOCUMENTS 4,892,111 A * 1/1990 Parslow, Jr. ..... F26B 21/004 34/58
6,327,994 B1 * 12/2001 Labrador ..... B63B 39/06 114/382
(Continued)

FOREIGN PATENT DOCUMENTS

DE 102007016120 A1 7/2008
DE 202019105406 U1 10/2019
(Continued)

OTHER PUBLICATIONS

Extended European Search Report dated Nov. 27, 2020 in a corresponding European patent application No. 20179783.4 (12pages).

*Primary Examiner* — Stephen M Gravini
(74) *Attorney, Agent, or Firm* — United IP Counselors, LLC

(57) ABSTRACT

Clamping an axially extending workpiece along a center axis and cleaning a shaft portion and an end to clean and dry the workpiece in a short period of time. A cleaning apparatus for cleaning the workpiece, including a cleaning chamber having a first side wall and a second side wall, a cleaning station including a cleaning axis, a cleaning nozzle, a first clamping device arranged on the first side wall, a second clamping device arranged on the second side wall, and a drying station including a drying axis, a drying nozzle, a second clamping device arranged on the second side wall, and a turn table having two regions arranged in a 180 degree rotational symmetry. The turn table arranges one of the two regions is arranged in the cleaning station, and the other in the drying station.

20 Claims, 14 Drawing Sheets

(51) Int. Cl.
*F26B 25/00* (2006.01)
*F26B 5/00* (2006.01)
*B08B 5/02* (2006.01)

(58) Field of Classification Search
USPC ..... 134/172
See application file for complete search history.

(56) References Cited

U.S. PATENT DOCUMENTS

| | | | | |
|---|---|---|---|---|
| 9,314,895 | B2 * | 4/2016 | Mori | B24B 57/02 |
| 11,318,503 | B2 * | 5/2022 | Haremaki | B08B 3/022 |
| 11,318,564 | B2 * | 5/2022 | Ma | B22F 12/222 |
| 2006/0003671 | A1 * | 1/2006 | Stumpf | B24B 37/345 451/41 |
| 2008/0155985 | A1 * | 7/2008 | Labrador | F02C 1/05 60/698 |
| 2019/0327980 | A1 * | 10/2019 | Paliawl | A21C 11/006 |
| 2021/0001379 | A1 * | 1/2021 | Kawamori | F26B 25/003 |
| 2021/0001380 | A1 * | 1/2021 | Kawamori | F26B 25/003 |
| 2021/0283746 | A1 * | 9/2021 | Mori | B24B 57/02 |
| 2021/0308805 | A1 * | 10/2021 | Ma | H05B 6/101 |

FOREIGN PATENT DOCUMENTS

| | | | | |
|---|---|---|---|---|
| EP | 1145774 | A2 | 10/2001 | |
| EP | 3760323 | A1 * | 1/2021 | B08B 13/00 |
| EP | 3760324 | A1 * | 1/2021 | B08B 13/00 |
| JP | 5432943 | B2 | 12/2013 | |
| JP | 5432943 | B2 | 3/2014 | |

* cited by examiner

CLEANING APPARATUS AND CLEANING METHOD

CROSS-REFERENCE TO RELATED APPLICATIONS

This application claims the benefit of priority to Japanese Patent Application No. 2019-126289, filed on Jul. 5, 2019 and Japanese Patent Application No. 2019-143283, filed on Aug. 2, 2019, the entire contents of which are hereby incorporated by reference.

BACKGROUND

1. Technical Field

The present invention relates to a cleaning apparatus and a cleaning method.

2. Description of the Background

A conventional cleaning apparatus includes a quill, a center post fixed to the quill, a turret head pivotally disposed on the center post, a tool support member disposed on the turret head, a cleaning tool rotatably disposed on the tool support member, a spindle, and a joint device. (See, for example, Japanese Patent No. 5,432,943.

In addition, a proposed cleaning apparatus includes a 180 degree turning table, in which a workpiece is installed and clamped on a cleaning table arranged on the turning table (Sugino Machine Co., Ltd., Catalog "JCC series Jet Clean Center Series of General-purpose High-Efficiency Cleaning Systems", Catalog No. Q2426N, pages 8 and 12).

BRIEF SUMMARY

When an axially extending workpiece such as a crankshaft is installed on the cleaning table and rotated together with the cleaning table, it is necessary to retract a nozzle when the cleaning table is rotated. In addition, it is difficult to bring an air blowing nozzle close to the workpiece.

An object of the present invention is to provide a cleaning apparatus and a cleaning method which clamps an axially extending workpiece on a center axis to clean an end portion and a shaft portion, and perform cleaning and drying in a short time.

A first aspect of the present invention provides a cleaning apparatus for cleaning a workpiece, the cleaning apparatus including:

a cleaning chamber having a first side wall, and a second side wall opposed to the first side wall, the cleaning chamber including a cleaning station having a cleaning axis, the cleaning station being provided with a cleaning nozzle, the cleaning station including a first clamping device arranged on the second side wall, and a second clamping device arranged on the first side wall, a drying station having a drying axis, the drying station being provided with a drying nozzle, the drying station including the first clamping device arranged on the second side wall, and the second clamping device arranged on the first side wall;

a turn table having two regions arranged in a 180 degree rotational symmetry, the turn table configured to arrange one of the two regions in the cleaning station and the other of the two regions in the drying station; and a cleaning table arranged in each of the two regions, the cleaning table including a journal block;

wherein each of the cleaning station and the drying station includes a lifter having a lift table, the lifter is configured to move up and down between a cleaning position and a retracted position, the lift table moves up to support the cleaning table at the cleaning position, and the cleaning table is placed on the turn table to retract the lift table below the turn table at the retracted position, the first clamping device includes a first slide shaft configured to reciprocate along the cleaning axis or the drying axis, a first clamp shaft supported in the first slide shaft in a rotatable manner about the cleaning axis or the drying axis to abut the workpiece, a first clamp driving device configured to reciprocate the first slide shaft, and a motor configured to rotate the first clamp shaft, the second clamping device includes a second slide shaft configured to reciprocate along the cleaning axis or the drying axis, a second clamp shaft supported in the second slide shaft in a rotatable manner about the cleaning axis or the drying axis to abut the workpiece, and a second clamp driving device configured to reciprocate the second slide shaft.

A second aspect of the present invention provides a cleaning method of axially extending workpiece, the cleaning method including:

loading the workpiece on a cleaning table;

lowering a lifter to place the cleaning table on a turn table;

turning the turn table to convey the workpiece from a drying station to a cleaning static moving the cleaning table by the lifter to align a center axis of the workpiece with a cleaning axis in the cleaning station;

clamping the workpiece by abutting a first clamp shaft extending from a first side wall of a cleaning chamber against a first end of the workpiece, and by abutting a second clamp shaft extending from a second side wall of the cleaning chamber opposed to the first side wall against a second end of the workpiece;

lowering the lifter to place the cleaning table on the turn table;

cleaning an outer circumferential surface of the workpiece while rotating the workpiece, the first clamp shaft, and the second clamp shaft together;

moving the cleaning table to a cleaning position by the lifter;

unclamping the workpiece by separating the first clamp shaft from the first end of the workpiece, and by separating the second clamp shaft from the second end of the workpiece;

lowering the lifter to place the cleaning table on the turn table;

turning the turn table to convey the workpiece from the cleaning station to the drying station;

moving the cleaning table to a drying position by the lifter to align the center axis of the workpiece with a drying axis in the drying station;

clamping the workpiece by abutting the first clamp shaft extending from the second side wall of the cleaning chamber against the first end of the workpiece, and by abutting the second clamp shaft extending from the first side wall of the cleaning chamber against the second end of the workpiece;

lowering the lifter to place the cleaning table on the turn table;

drying the outer circumferential surface of the workpiece while rotating the workpiece, the first clamp shaft, and the second clamp shaft together;

moving the cleaning table to the drying position by the lifter;

unclamping the workpiece by separating the first clamp shaft from the first end of the workpiece, and by separating the second clamp shaft from the second end of the workpiece; and unloading the dried workpiece from the cleaning table.

The cleaning includes debarring by a high pressure jet.

The insertion portion and the receiving portion are, for example, a pair of couplings, a cylindrical pin and a cylindrical hole into which the cylindrical pin is inserted. Preferably, the tip of the cylindrical pin has a conical portion. Instead of the cylindrical pin, a diamond locating pin may be used. Preferably, two the insert portions and two the receiving portions are arranged on the cleaning table apart from each other.

By moving the guide groove along the guide, it is possible to suppress the position of the cleaning table in the horizontal direction from shifting when the cleaning table moves to the cleaning position or the drying position. The guide may be disposed from the lower end to a height in the middle of the distance of movement of the cleaning table. Since the guide groove is restricted to the guide, it is possible to suppress the cleaning table from falling off from the turn table when the turn table turns.

Instead of the guide groove, for example, a guide hole or a guide block may be used. If the guide block moves up and down on the guide so that the cleaning table can be raised accurately to the cleaning position, the insert portion and the receiving portion may be omitted.

The passage opening preferably opens outwardly as viewed from the turning axis.

The cleaning apparatus may include a guide arranged to extend in the vertical direction on the turn table, and a guide groove slightly larger than the horizontal cross-sectional shape of the guide arranged on the cleaning table.

The second insertion portion and the second receiving portion are positioning members, for example, a cylindrical pin and a cylindrical hole into which the cylindrical pin is inserted. Preferably, the tip of the cylindrical pin has a conical portion. The cylindrical hole may fit into the cylindrical pin. Instead of the cylindrical pin, a diamond locating pin may be used.

As the lifter moves up and down, the lift table passes through the passage opening of the turn table. As the lifter rises, the lift table passes through the turn table upwardly from below, and the cleaning table is placed on the lift table, and the lift table lifts up the cleaning table to the cleaning position or the drying position. When the lifter descends, the lift table is retracted below the turn table with the cleaning table placed on the turn table.

The lift cylinder is, for example, an air cylinder or an electric cylinder.

The first clamp driving device and the second clamp driving device are, for example, an air cylinder or an electric cylinder.

According to the cleaning apparatus and the cleaning method of the present invention, an axially extending workpiece is clamped on the center axis, and the end portion and the shaft portion is cleaned, and cleaning and drying is performed in a short time.

DETAILED DESCRIPTION

Figure 1:
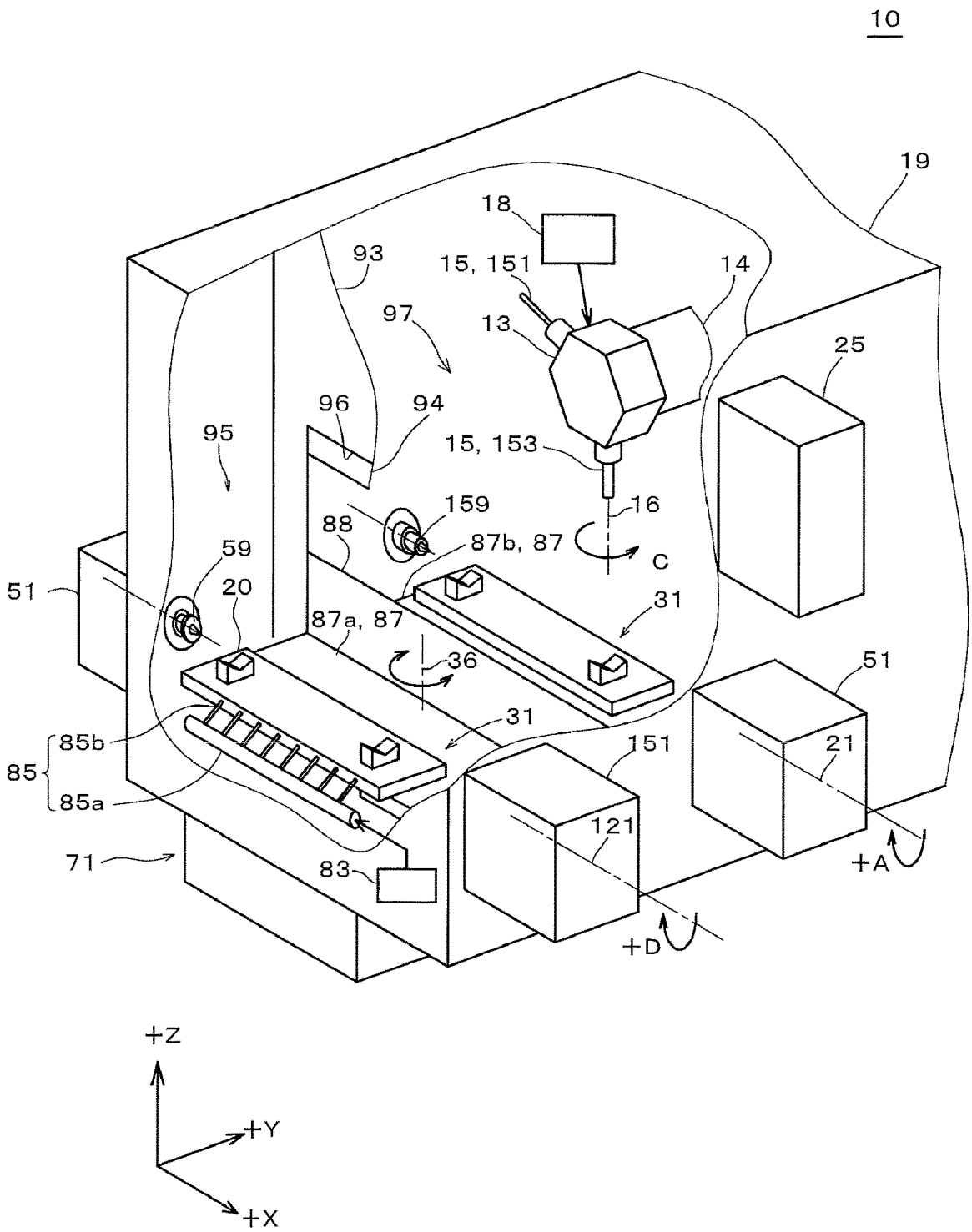
FIG. 1 is a schematic configuration diagram of a cleaning apparatus of the embodiment.

As shown in FIG. 1, the cleaning apparatus 10 includes a cleaning chamber 19, a partition wall 93, an intermediate shutter 94, a turn table 87, a cleaning table 31, a clamping device (first clamping device) 51, a clamping device (second clamping device) 151, a lifter 71, a moving device 14, a nozzle 15, an air blowing device 85, and a control device 25. The cleaning apparatus 10 may include a turret 13, a pump 18, and an air source 83.

The cleaning chamber 19 is, for example, box-shaped. The cleaning chamber 19 has a drying station 95 at the front and a cleaning station 97 at the rear. The nozzle 15 and the moving device 14 are arranged in the cleaning station 97.

The turn table 87 is arranged across the cleaning station 97 and the drying station 95. The turn table 87 includes two regions 87*a*, 87*b* and a movable wall 88. The movable wall 88 partitions the turn table 87 into two regions 87*a*, 87*b*. The turn table 87 turns about the turning axis 36 by 180 degrees. The turning axis 36 extends in the vertical direction (Z-axis direction) on the boundary between the cleaning station 97 and the drying station 95.

The regions 87*a*, 87*b* are arranged in a 180 degree rotational symmetry about the turning axis 36. At the turning end, the turn table 87 positions one of the two regions 87*a*, 87*b* at the cleaning station 97 and the other at the drying station 95.

The movable wall 88 is a flat plate and is fixed to the turn table 87 on a plane passing through the turning axis 36 and perpendicular to the turn table 87. When the turn table 87 is positioned, the movable wall 88 is connected to the partition wall 93. The movable wall 88 turns about the turning axis 36 together with the turn table 87.

The partition wall 93 is a flat plate and is disposed in the cleaning chamber 19. The partition wall 93 partitions the cleaning chamber 19 into the cleaning station 97 and the drying station 95. The partition wall 93 passes through the turning axis 36 and extends parallel to the XZ plane. The partition wall 93 has a conveyance port 96. When the turn table 87 turns, the turn table 87, the cleaning table 31, and the workpiece 3 pass through the conveyance port 96.

The intermediate shutter 94 opens and closes the conveyance port 96. For example, the intermediate shutter 94 is a sliding door that slides up and down. When the intermediate shutter 94 is lowered, the intermediate shutter 94 contacts the movable wall 88. When the intermediate shutter 94 comes into contact with the movable wall 88, the conveyance port 96 is closed.

A loading port (not shown) is located at the drying station 95. The loading port is disposed, for example, on the front surface or the upper surface of the cleaning apparatus 10. The loading shutter (not shown) opens and closes the loading port. The loading shutter is, for example, a slide door.

A pair of clamping devices 51, 151 and a lifter 71 are arranged both in the drying station 95 and the cleaning station 97. In the drying station 95, the clamping device 51 is arranged on the left side and the clamping device 151 is arranged on the right side. In the cleaning station 97, the clamping device 51 is arranged on the right side and the clamping device 151 is arranged on the left side. The lifter 71 is disposed below the cleaning chamber 19.

The clamping device 51 includes a clamp shaft 59. The clamping device 151 includes a clamp shaft 159. At the drying station 95, the clamp shafts 59 and 159 rotate about a drying axis 121. At the cleaning station 97, the clamp shafts 59 and 159 rotate about a cleaning axis 21. For example, the drying axis 121 has the same height as the cleaning axis 21. The moving device 14 moves the nozzle 15 relative to the workpiece 3.

The pump 18 is a liquid pump such as a piston pump, a gear pump, or a centrifugal pump. The pump 18 supplies cleaning liquid supplied from a cleaning liquid tank (not shown) to the nozzle 15 via the turret 13.

The moving device 14 freely moves the turret 13 and the nozzle 15 in the left-right direction (X-axis direction), the front-rear direction (Y-axis direction), and the vertical direction (Z-axis direction) with respect to the cleaning table 31.

The clamping devices 51, 151 clamp the workpiece 3 in the direction of the cleaning axis 21 and rotate about the cleaning axis 21 in the A-axis direction.

The turret 13 is provided on the moving device 14. The turret 13 has a nozzle rotation axis 16 extending in the Z-axis direction. The turret 13 may have a plurality of nozzles 15. The turret 13 rotates to select one nozzle 15. The turret 13 supplies the cleaning liquid to the selected nozzle 15. The moving device 14 or the turret 13 rotates the nozzle 15 about the nozzle rotation axis 16 in the C-axis direction. As the turret 13, for example, Japanese Patent Nos. 6147623 and 5432943 are known.

The nozzle 15 is provided in the turret 13. Preferably, the nozzle 15 rotates about the nozzle rotation axis 16 or is positioned in a rotational direction. The nozzle 15 is, for example, a lateral nozzle 153 or a flat spray nozzle 155. For example, as shown in FIG. 7C, the lateral nozzle 153 has a shaft body 15*a* and an injection port 15*b*. The injection port 15*b* is disposed at the distal end portion of the shaft body 15*a*, and has an axis line 22 perpendicular to the shaft body 15*a*. The injection port 15*b* injects the high-pressure jet 20 along the axis line 22.

The air source 83 is, for example, a compressor or a blower. The air blowing device 85 includes an air blowing pipe 85*a* and a plurality of air blowing nozzles 85*b*. The air blowing pipe 85*a* is disposed, for example, below the front of the drying station 95. The air blowing pipe 85*a* extends in parallel with the cleaning axis 21. The plurality of air blowing nozzles 85*b* are arranged along the air blowing pipe 85*a*. The air blowing nozzle 85*b* extends from the air blowing pipe 85*a* toward the drying axis 121. The air blowing nozzle 85*b* is connected to the air source 83 via an air blowing pipe 85*a*.

The control device 25 controls the moving device 14, the clamping devices 51 and 151, the lifter 71, the turn table 87, the pump 18, and the air source 91.

Figure 2:
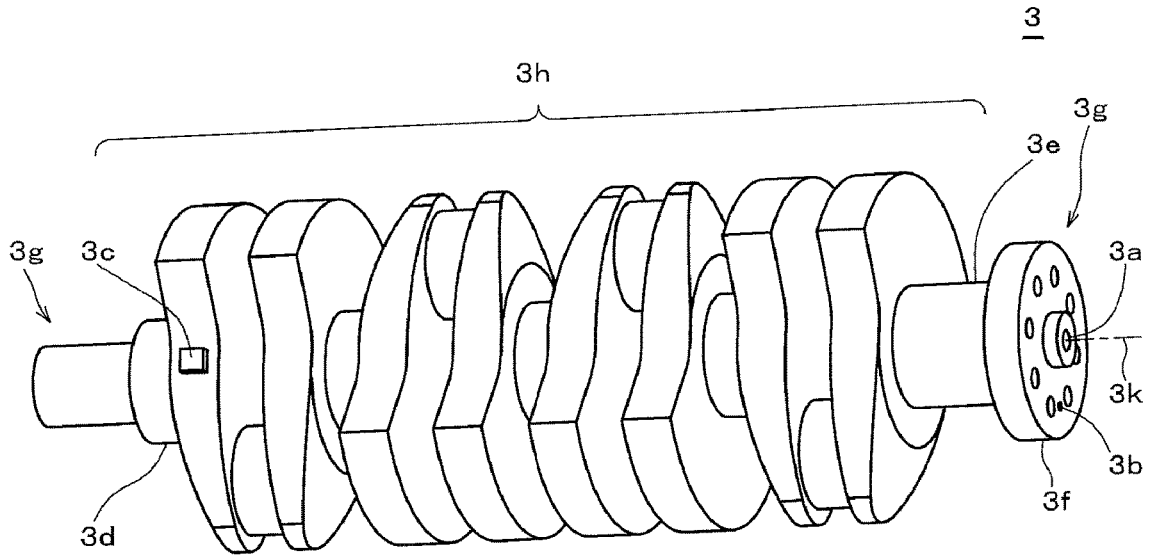
FIG. 2 is a perspective view of a workpiece of the embodiment.

As shown in FIG. 2, the workpiece 3 of the present embodiment is, for example, a crankshaft. The workpiece 3 includes a flange 3*f*, a phasing surface 3*c*, a journal (first journal) 3*d*, a journal (second journal) 3*e*, a center hole 3*a*, a phasing hole 3*b*, an end 3*g*, a shaft portion 3*h* and a center axis 3*k*. When the workpiece 3 is installed in the drying station 95, for example, the flange 3*f* is located at the left end from the front, and the phasing surface 3*c* is located at the right end (see FIG. 7H). The first journal 3*d* is located at the right end, and the second journal 3*e* is located at the left end.

The center hole 3*a* is, for example, conical. The center holes 3*a* are arranged at both ends of the workpiece 3. The phasing hole 3*b* is, for example, a cylindrical hole arranged in the flange 3*f* away from the center axis 3*k* and extends along the center axis 3*k*. The phasing surface 3*c* is, for example, a plane arranged parallel to the center axis 3*k*. The center axis 3*k* is the rotational center of the workpiece 3.

Hereinafter, the region 87*b*, the cleaning table 31, the lifter 71, the clamping device 51, and the clamping device 151 will be described in a state that the region 87*b* is positioned at the cleaning station 97. The region 87*a* and the drying station 95 are substantially the same as the region 87*b* and the cleaning station 97.

Figure 3:
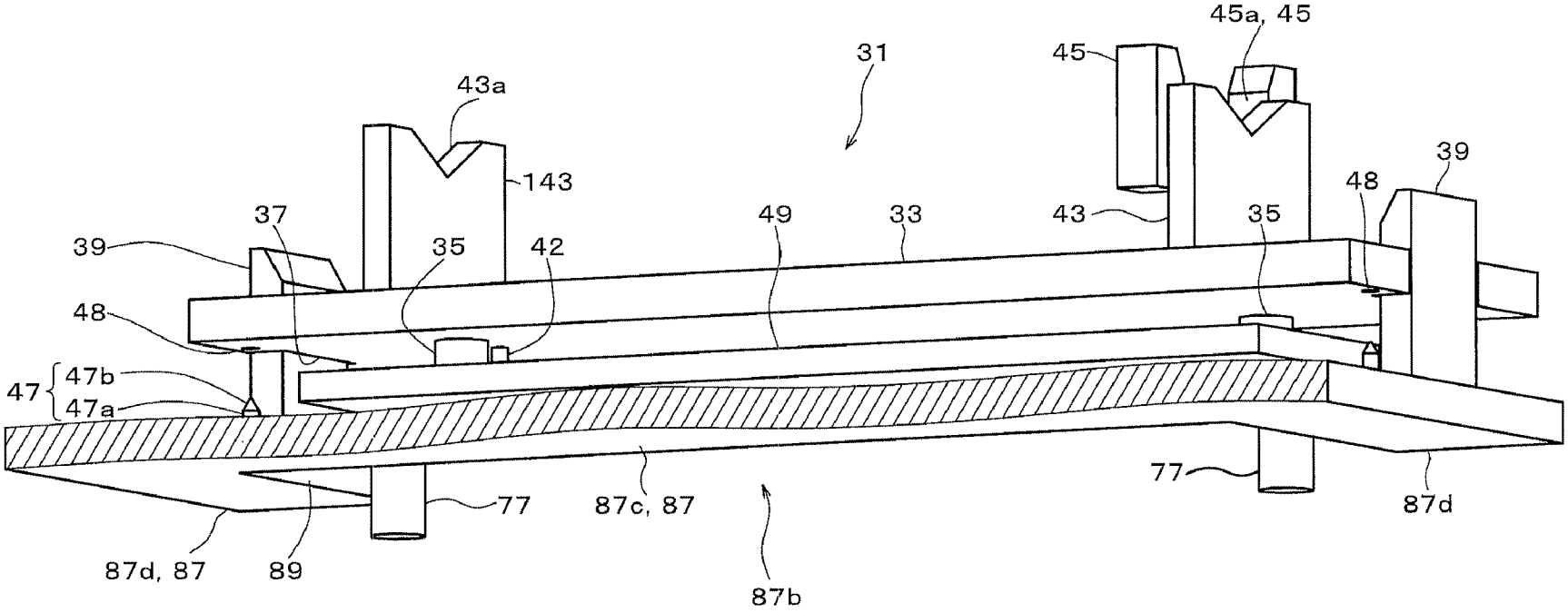
FIG. 3 is a perspective view of a cleaning table of the erribodiment.

FIG. 3 is a perspective view of the cleaning table 31 in which the lifter 71 is ascending, as viewed obliquely from the lower front. As shown in FIG. 3, the turn table 87 has a passage opening 89. The turn table 87 may include a guide 39, a round pin (second insertion portion) 47. The passage opening 89, the guide 39, and the round pin 47 are disposed in the region 87*b*.

The passage opening 89 is a rectangular cutout opened rearward. In other words, the turn table 87 includes a center plate 87*c* and a projecting portion 87*d*. The projecting portions 87*d* extend rearward from the left and right end portions of the center plate 87*c*.

The pair of guides 39 are respectively disposed at the center of the projecting portion 87*d* in the front-rear direction. The guide 39 is a so-called rough guide. The guide 39 extends in the vertical direction and is disposed on the turn table 87. The guide 39 has a thin prism shape, and has an inclined surface whose tip portion inclines outward.

The pair of round pins 47 are respectively disposed at the distal end of the upper surfaces of the projecting portion 87*d*. The round pin 47 includes a cylindrical portion 47*a* and a tapered portion 47*b*. The tapered portion 47*b* has a conical shape, and is disposed above the cylindrical portion 47*a* so as to be continuous with the cylindrical portion 47*a*.

Figure 4:
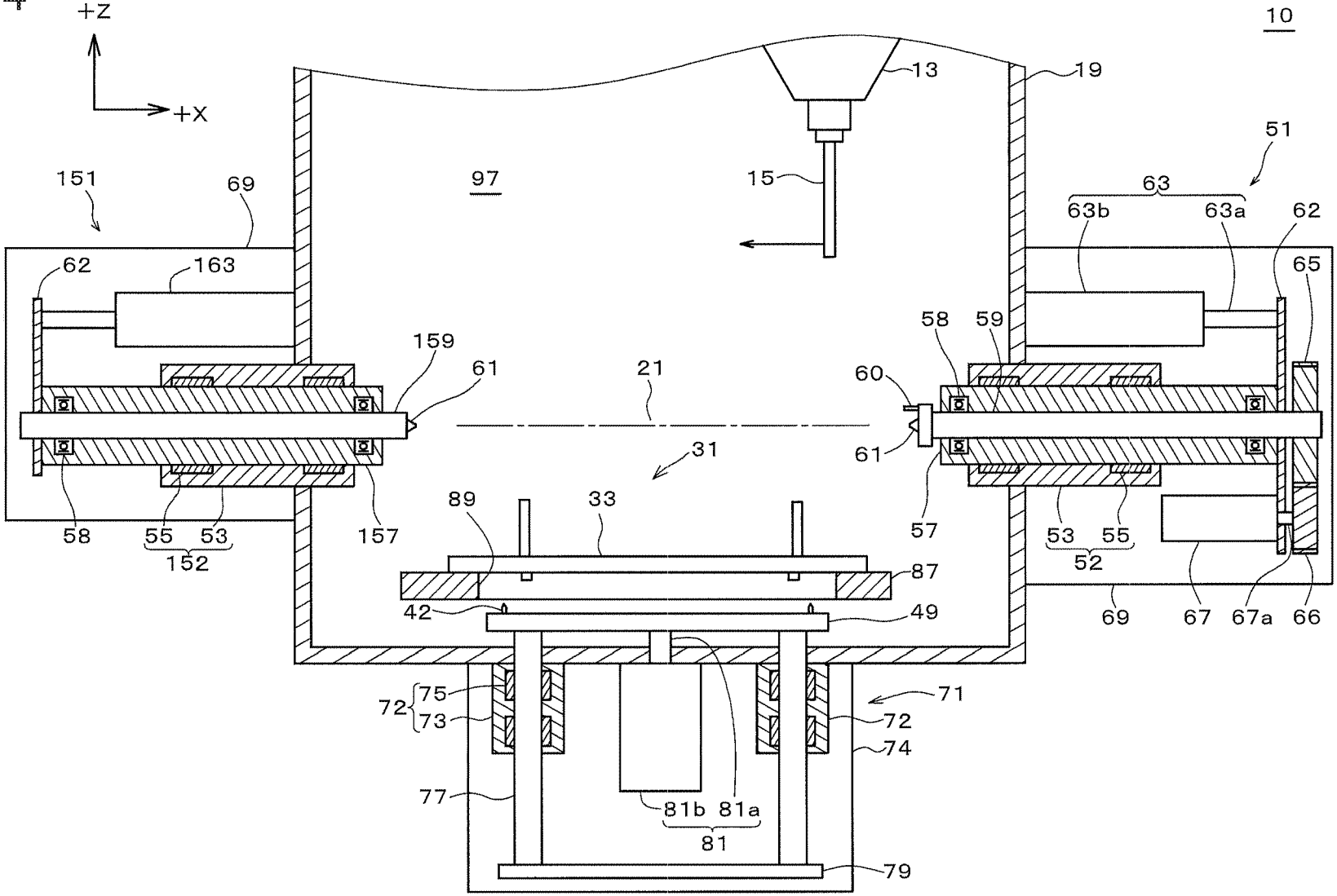
FIG. 4 is a cross-sectional view of the cleaning apparatus of the embodiment.

FIG. 4 is a cross-sectional view of a vertical plane passing through the cleaning axis 21 as viewed from the front. As shown in FIG. 4, the clamping device 51 includes a guide bush (first guide bush) 52, a slide shaft (first slide shaft) 57, a bearing 58, a clamp shaft (first clamp shaft) 59, a motor (clamp shaft motor) 67, a driving gear 66, a driven gear 65, a connecting plate 62, and a clamp cylinder (first clamp driving device) 63. Preferably, the clamping device 51 includes a cover 69, a center pin 61 and a phasing pin 60.

The guide bush 52 may include a housing 53 and a bush 55. The housing 53 has, for example, a hollow cylindrical shape, and is disposed coaxially with the cleaning axis 21. The housing 53 is disposed, for example, through a side wall of the cleaning chamber 19.

The slide shaft 57 has, for example, a hollow cylindrical shape, and is arranged coaxially with the cleaning axis 21. The slide shaft 57 slides in the bush 55 and reciprocates in the left-right direction (X-axis direction). The slide shaft 57 includes a bearing 58 therein. The clamp shaft 59 is cylindrical and is supported by the bearing 58. The clamp shaft 59 is arranged coaxially with the cleaning axis 21. The center pin 61 and the phasing pin 60 are disposed on the distal end surface of the clamp shaft 59. Here, the distal end is an end on the side of the workpiece 3, and the basal end is an end on the side opposite to the workpiece 3. The center pin 61 has a conical shape and is disposed coaxially with the cleaning axis 21. The phasing pin 60 is disposed at a position away from the cleaning axis 21 and parallel to the cleaning axis 21. The center pin 61 and the phasing pin 60 are inserted into the center hole 3*a* and the phasing hole 3*b* of the workpiece 3, respectively. When inserted into the workpiece 3, the center pin 61 and the phasing pin 60 abut against the center hole 3*a* and the phasing hole 3*b*.

The connecting plate 62 is disposed at the basal end of the slide shaft 57.

The clamp cylinder 63 includes a rod 63*a* and a cylinder 63*b*. For example, the cylinder 63*b* is connected to the cleaning chamber 19, and the rod 63*a* is connected to the connecting plate 62. The clamp cylinder 63 is an electric cylinder, and is numerically controlled by the control device 25. When the clamp cylinder 63 contracts, the slide shaft 57 advances (advances to the left). When the clamp cylinder 63 extends, the slide shaft 57 retreats (advances to the right).

The motor 67 is disposed on the connecting plate 62. The motor 67 includes an output shaft 67*a*. The motor 67 is, for example, a servo motor.

The driving gear 66 is fixed to the output shaft 67*a*. The driven gear 65 is fixed to the clamp shaft 59 and meshes with the driving gear 66. The driving gear 66 and the driven gear 65 are, for example, spur gears and helical gears.

Preferably, the clamp cylinder 63, the connecting plate 62, the driven gear 65, the driving gear 66, and the motor 67 are disposed outside the cleaning chamber 19.

The cover 69 is a safety cover, and covers the guide bush 52, the slide shaft 57, the driving gear 66, the driven gear 65, the connecting plate 62, the clamp cylinder 63, and the motor 67.

The clamping device 151 includes a guide bush (second guide bush) 152, a slide shaft (second slide shaft) 157, a bearing 58, a connecting plate 62, and a clamp cylinder (second clamp drive device) 163. Preferably, the clamping device 151 includes a cover 69 and a center pin 61. The guide bush 152 has the same structure as the guide bush 52. The slide shaft 157 has the same structure as the slide shaft 57. The center pin 61 is disposed at the right end of the clamp shaft 159. The clamp cylinder 163 has the same structure as the clamp cylinder 63.

The lifter 71 includes a lift table 49, a lift guide 72, a stem 77, and a lift cylinder 81. The lifter 71 may include a cover 74 and a connecting plate 79.

The lift guide 72 has a housing 73 and a bush 75, and is disposed below the cleaning chamber 19. The housing 73 has a hollow cylindrical shape and extends in the vertical direction. The bush 75 is disposed inside the housing 73.

Figure 5:
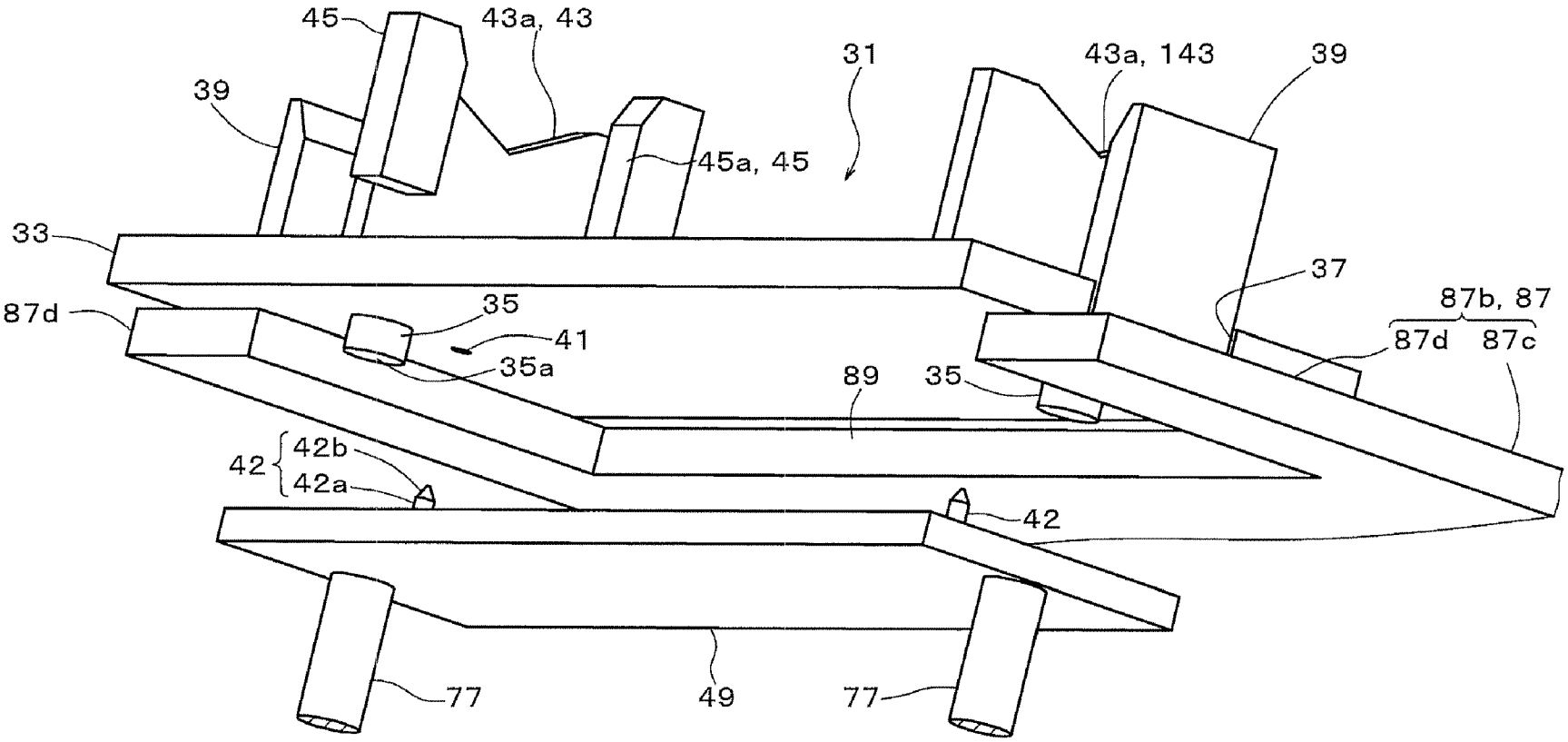
FIG. 5 is a perspective view of the cleaning table of the embodiment.

FIG. 5 is a perspective view of the cleaning table 31 in a state in which the lifter 71 is lowered, as seen from a front obliquely lower side. As shown in FIG. 5, the lift table 49 has a round pin (first inserting portion) 42 on its upper surface. The lift table 49 is a rectangular flat plate. The round pin 42 includes a cylindrical portion 42*a* and a tapered portion 42*b*. The tapered portion 42*b* has a conical shape, and is disposed above the cylindrical portion 42*a* so as to be continuous with the cylindrical portion 42*a*. In plan view, the lift table 49 overlaps the passage opening 89 when the turn table 87 is positioned, and is smaller than the passage opening 89.

The stem 77 has, for example, a cylindrical shape. As shown in FIG. 4, the stem 77 slides in the bush 75 and reciprocates in the vertical direction (Z-axis direction). The upper portion of the stem 77 is connected to the lift table 49. Preferably, the stem 77 is disposed through the bottom surface of the cleaning chamber 19. Preferably, a plurality of stems 77 are disposed.

The connecting plate 79 connects the lower end of the stem 77.

The lift cylinder 81 is disposed in the cleaning chamber 19. The lift cylinder 81. includes a cylinder 81*b* and a rod 81*a*. For example, the cylinder 81*b* is disposed on the bottom surface of the cleaning charriber 19. The distal end of the rod 81*a* is connected to the lift table 49. For example, the lift cylinder 81 is an electric cylinder, and is numerically controlled by the control device 25. When the lift cylinder 81 extends, the cleaning table 31 rises. When the lift cylinder 81 contracts, the cleaning table 31 lowers. The rod 81*a* may be connected to the connecting plate 79.

The cover 74 is a safety cover and covers the stem 77, the lift guide 72, the lift cylinder 81, and the connecting plate 79.

As shown in FIG. 5, the cleaning table 31 includes a top plate 33, a journal block (first journal block) 43, and a journal block (second journal block) 143. The cleaning table 31 may include a cylindrical hole (first receiving portion) 41, a support base 35, a cylindrical hole (second receiving portion) 48 (see FIG. 3), a guide groove 37, and a phasing block 45.

The top plate 33 has a rectangular shape. When the lifter 71 is lowered, the top plate 33 is placed on the turn table 87.

The journal block 43 is a V-block and is disposed on the upper surface of the cleaning table 31. The journal block 43 has a V-surface 43*a* on its center.

The journal block 143 is substantially to the same as the journal block 43.

The phasing block 45 is arranged, for example, near the center of the journal block 43. The phasing block 45 has a phasing surface 45*a*. The phasing surface 45*a* is disposed, for example, in parallel with the XZ plane, toward the cleaning axis 21 so as to sandwich the cleaning axis 21. The phasing surface 45*a* abuts the phasing surface 3*c* of the workpiece 3.

The support base 35 is, for example, a cylinder. The support base 35 is disposed inside the passage opening 89 in plan view, and extends below the top plate 33. The lower surface of the support base 35 is a contact surface 35*a*. When the lifter 71 rises, the contact surface 35*a* comes into contact with the lift table 49.

The guide grooves 37 are arranged at the left and right ends of the top plate 33. The guide groove 37 is rectangular in plan view and extends in the vertical direction. The guide groove 37, at a position matching the guide 39, is disposed to have a gap between the guide groove and the guide 39. When the lifter 71 moves up and down, the, guide groove 37 is guided by the guide 39.

The cylindrical hole 41 is disposed on the lower surface of the cleaning table 31. Preferably, the cylindrical holes 41 are disposed at the left and right end portions, respectively. When the lifter 71 rises, the round pin 42 is inserted into the cylindrical hole 41. At this time, the cylindrical hole 41 and the cylindrical portion 42*a* are fitted to each other.

As shown in FIG. 3, the cylindrical hole 48 is disposed on the lower surface of the cleaning table 31. Preferably, the cylindrical holes 48 are disposed at the left and right ends, respectively. The round pin 47 is inserted into the cylindrical hole 48 when the lifter 71 is lowered and the cleaning table 31 is lowered to the turn table 87. At this time, the cylindrical hole 48 and the cylindrical portion 47*a* come into contact with each other.

Figure 6:
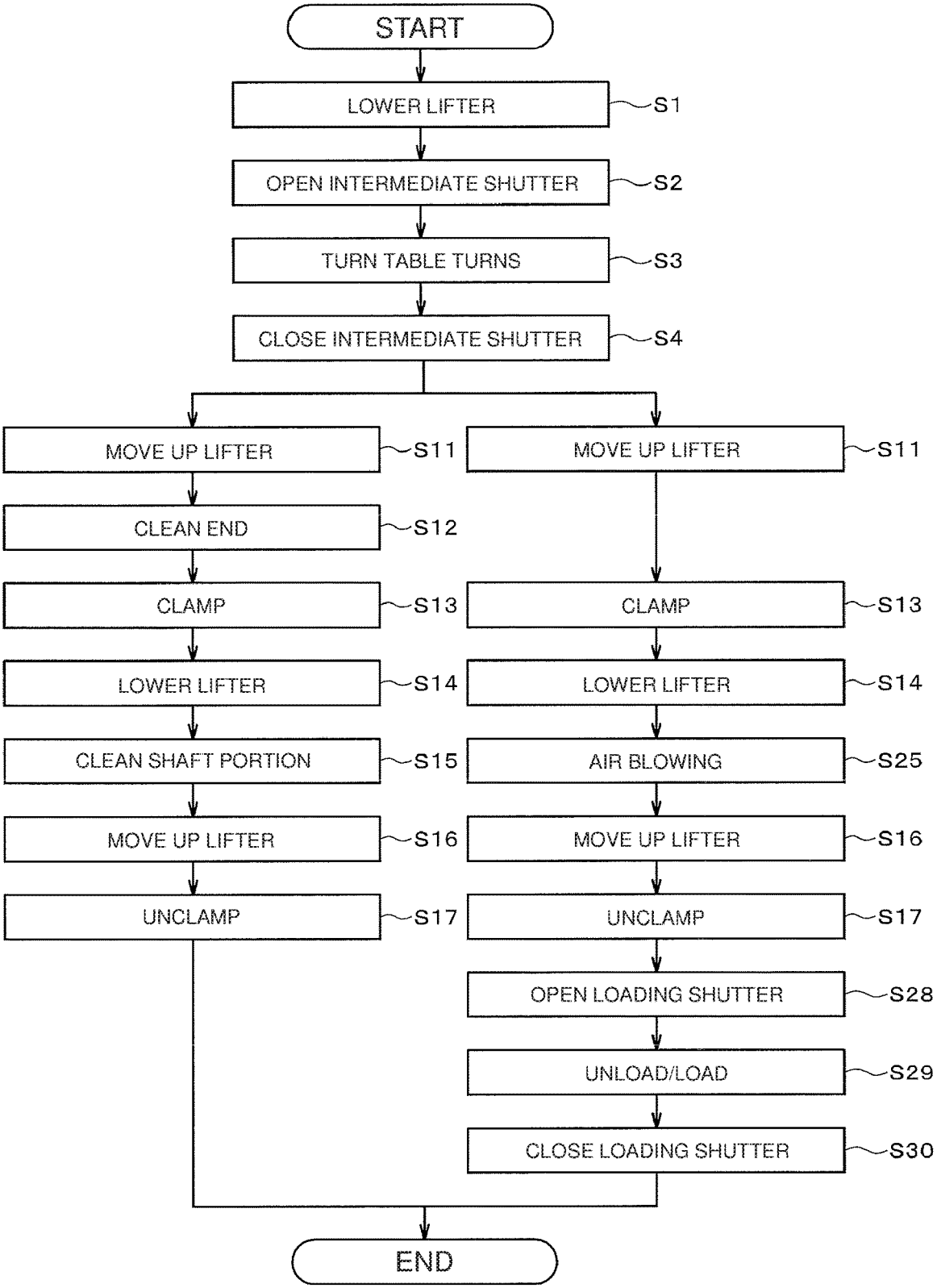
FIG. 6 is a flowchart showing the cleaning method of the embodiment.

Next, the cleaning method will be described with reference to FIG. 6 and FIGS. 7A to 7H. In FIG. 6, the flow chart branching to the left shows the cleaning method by the cleaning station 97, and the flow chart branching to the right shows the drying method in the drying station 95.

Figure 7A:
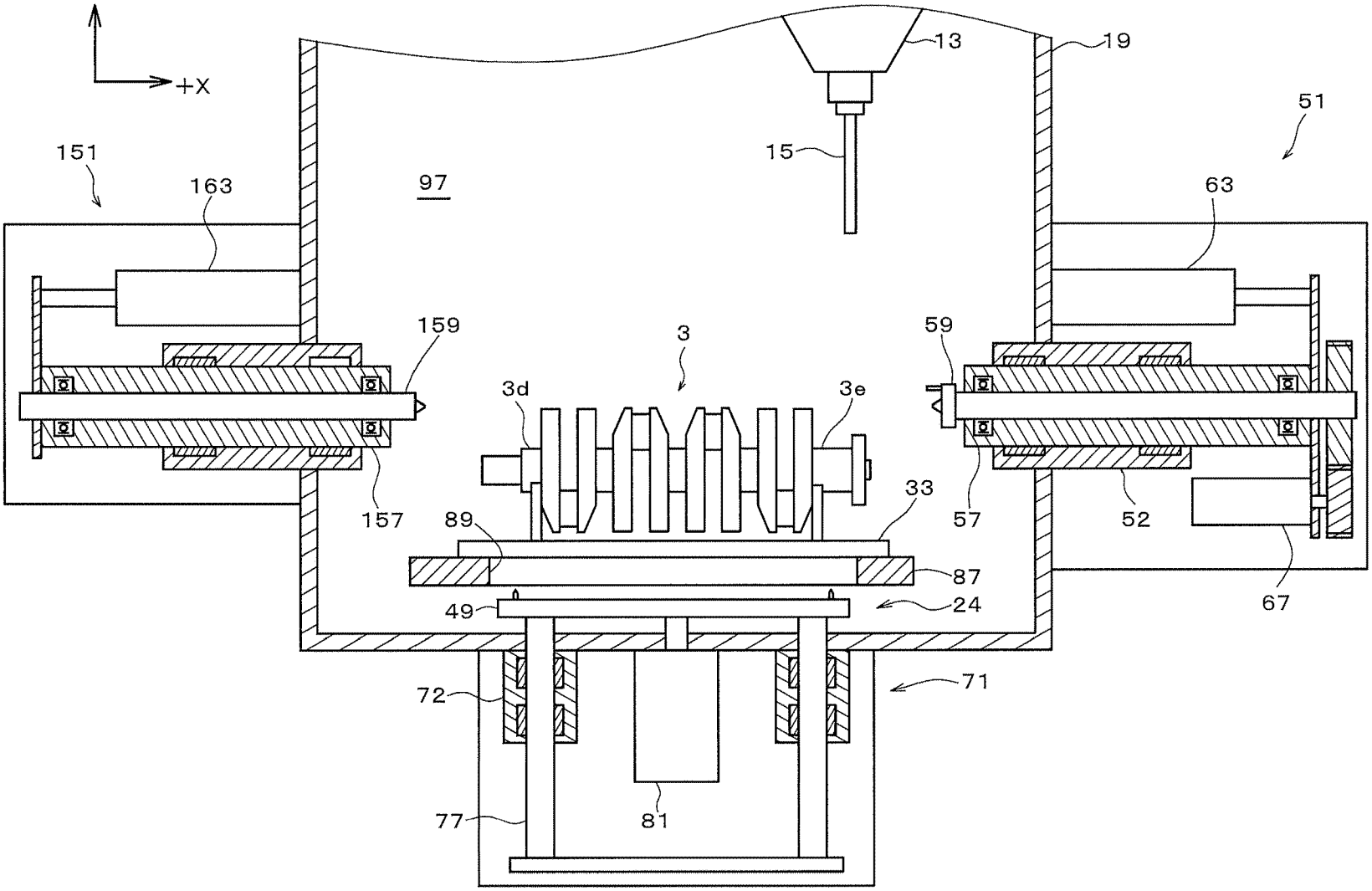
FIG. 7A is a cross-sectional view showing a state before turning a turning table of the embodiment.

As shown in FIG. 7A, in the drying station 95 and the cleaning station 97, the lifter 71 lowers the cleaning table 31 on which the workpiece 3 is mounted onto the turn table 87. In step S1, the lifter 71 moves down to the retracted position 24. Here, the retracted position 24 is a position at which the lift table 49 does not interfere with the turn table 87 when the lift table 49 is positioned below the turn table 87 and the turn table 87 turns. When the lifter 71 moves down, the lift table 49 passes through the passage opening 89. The retracted position 24 may be the same position regardless of the type of the workpiece 3. For example, it is preferable to set the lowest end to the retracted position 24.

Next, in step S2, the intermediate shutter 94 is opened. As a result, the conveyance port 96 is opened.

Next, the turn table 87 is turned. In step S3, with the workpiece 3 before cleaning and the cleaning table 31 being carried on, the region 87*a* in the drying station 95 moves to the cleaning station 97. With the workpiece 3 after cleaning and the cleaning table 31 being carried on, the region 87*b* in the cleaning station 97 moves to the drying station.

Next, in step S4, the intermediate shutter 94 is closed. This separates the cleaning station 97 from the drying station 95.

Next, a cleaning process in the cleaning station 97 will be described.

Figure 7B:
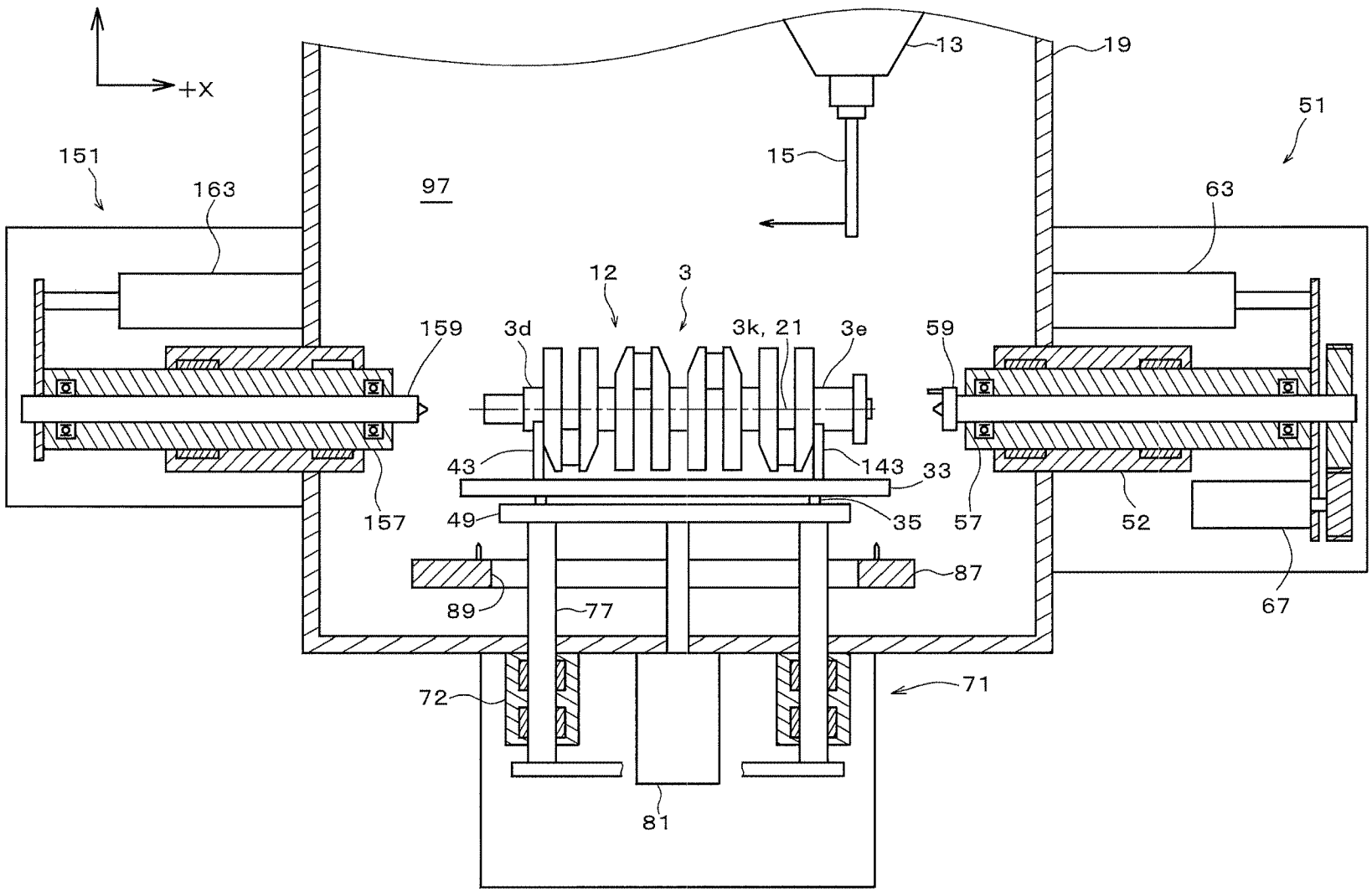
FIG. 7B is a cross-sectional view showing a state in which the workpiece of the embodiment is raised.
Figure 7C:
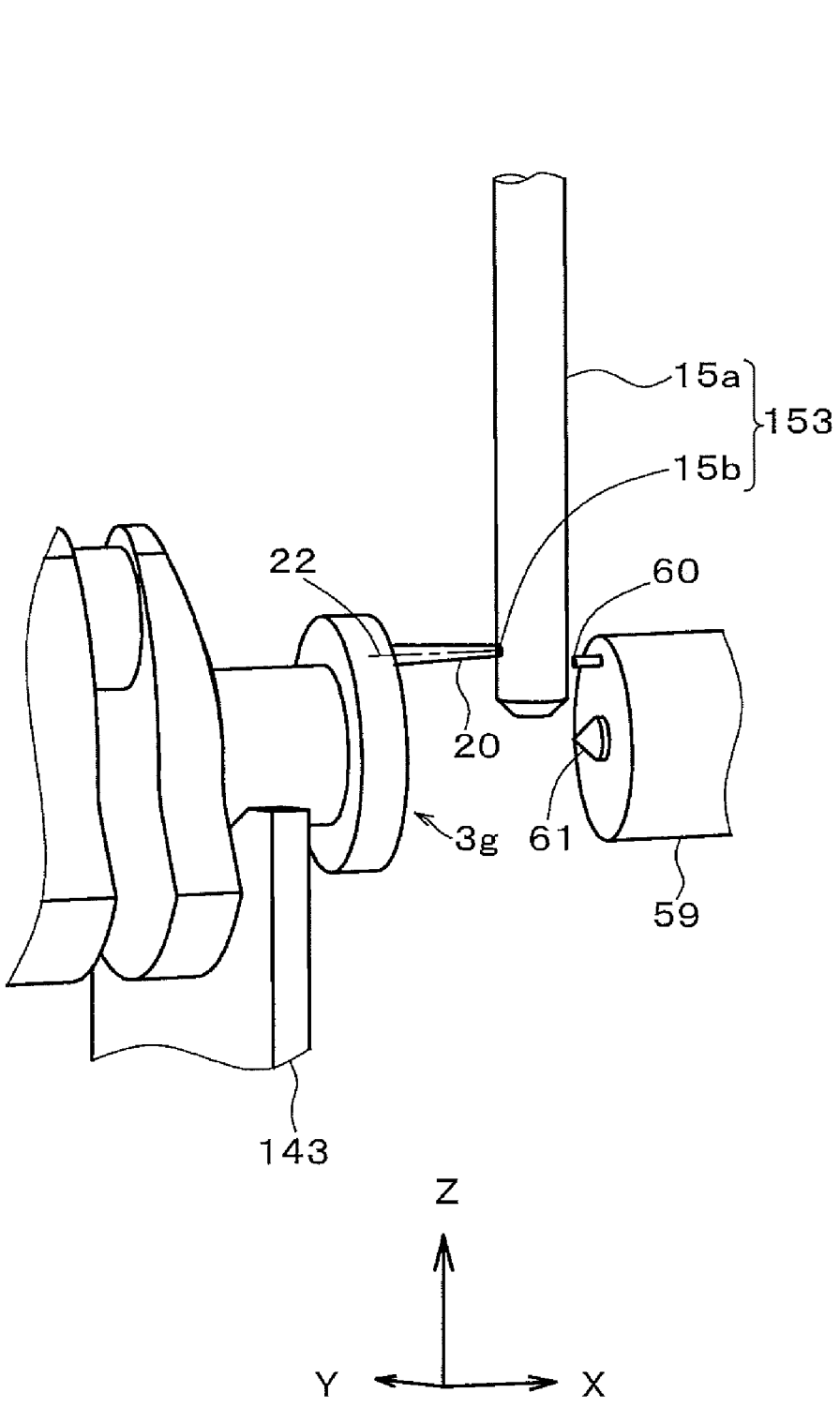
FIG. 7C is a perspective view showing a cleaning state of an end portion of the embodiment.

As shown in FIG. 7B, the lifter 71 raises the cleaning table 31 in step S11. The lift table 49 passes through the passage opening 89 and supports the cleaning table 31. Subsequently, the lift table 49 rises and the cleaning table 31 reaches a cleaning position 12. In the cleaning position 12, the center axis 3*k* is aligned with the cleaning axis 21.

The pump 18 supplies the cleaning liquid to the nozzle 15. The nozzle 15 ejects the cleaning liquid. As shown in FIG. 7C, the moving device 14 inserts the nozzles 15 between the clamp shafts 59, 159 and the workpiece 3, and causes the jet to collide with the workpiece 3 to clean the both ends 3*g* of the workpiece 3 in step S12. Thereafter, the moving device 14 moves the nozzle 15 upward to retract.

Figure 7D:
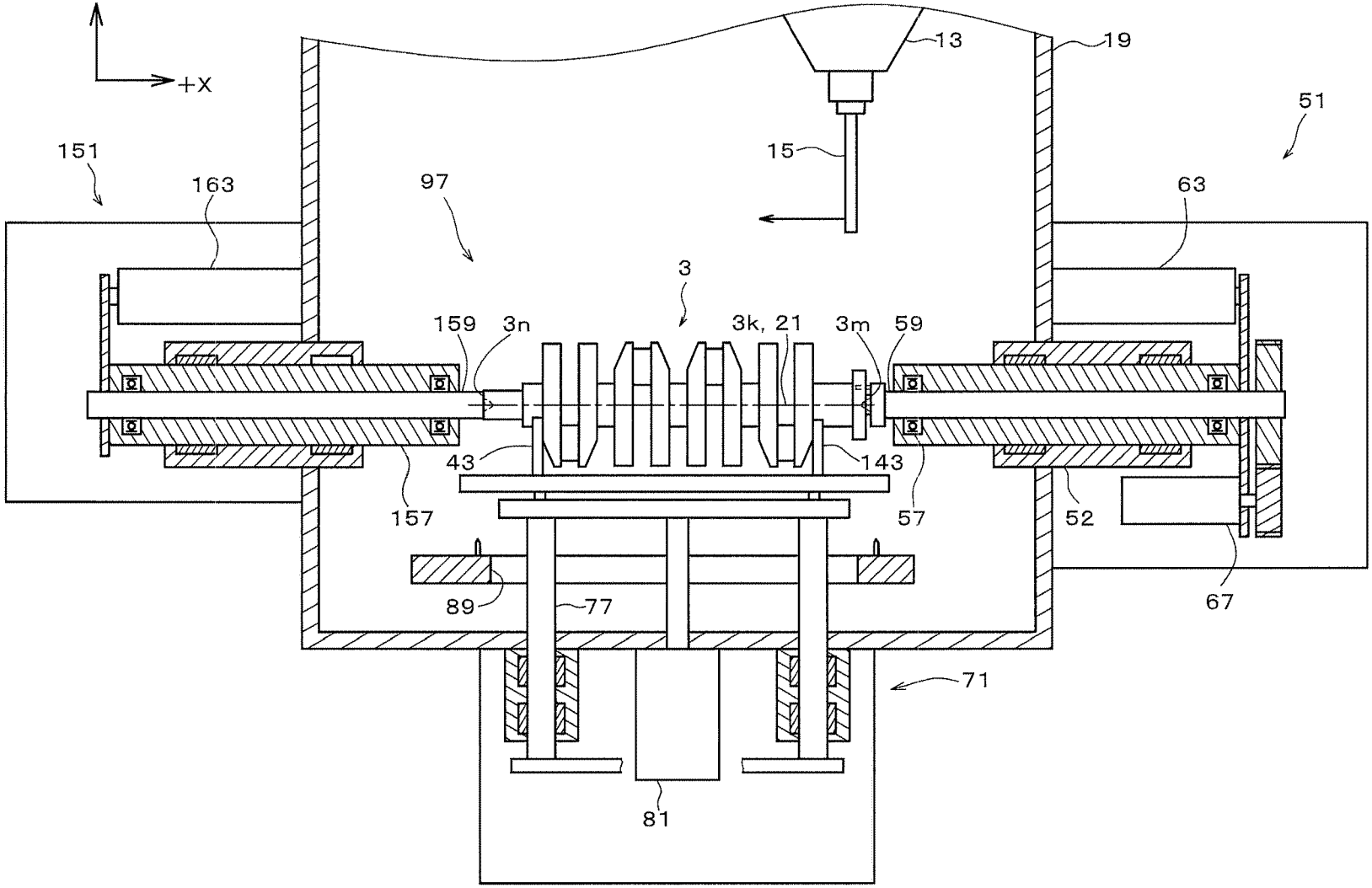
FIG. 7D is a cross-sectional view showing a clamped state of the embodiment.

As shown in FIG. 7D, the clamp cylinder 63 advances the slide shaft 57. The clamp shaft 59 abuts against the first end 3*m* of the workpiece 3. The center pin 61 is inserted into the center hole 3*a*. Phasing pin 60 is inserted into the phasing hole 3*b*. The clamp cylinder 63 presses the clamp shaft 59 against the first end 3*m*. The control device 25 controls the displacement of the clamp shaft 59 based on the position of the first end 3*m*.

The clamp cylinder 163 advances the slide shaft 157. The clamp shaft 159 abuts against the second end 3*n* of the workpiece 3. The clamp cylinder 163 presses the clamp shaft 159 against the second end 3*n*. The control device 25 controls the displacement of the clamp shaft 159 based on the position of the second end 3*n*. In this manner, the workpiece 3 is clamped to the clamp shafts 59 and 159 in step S13.

Figure 7E:
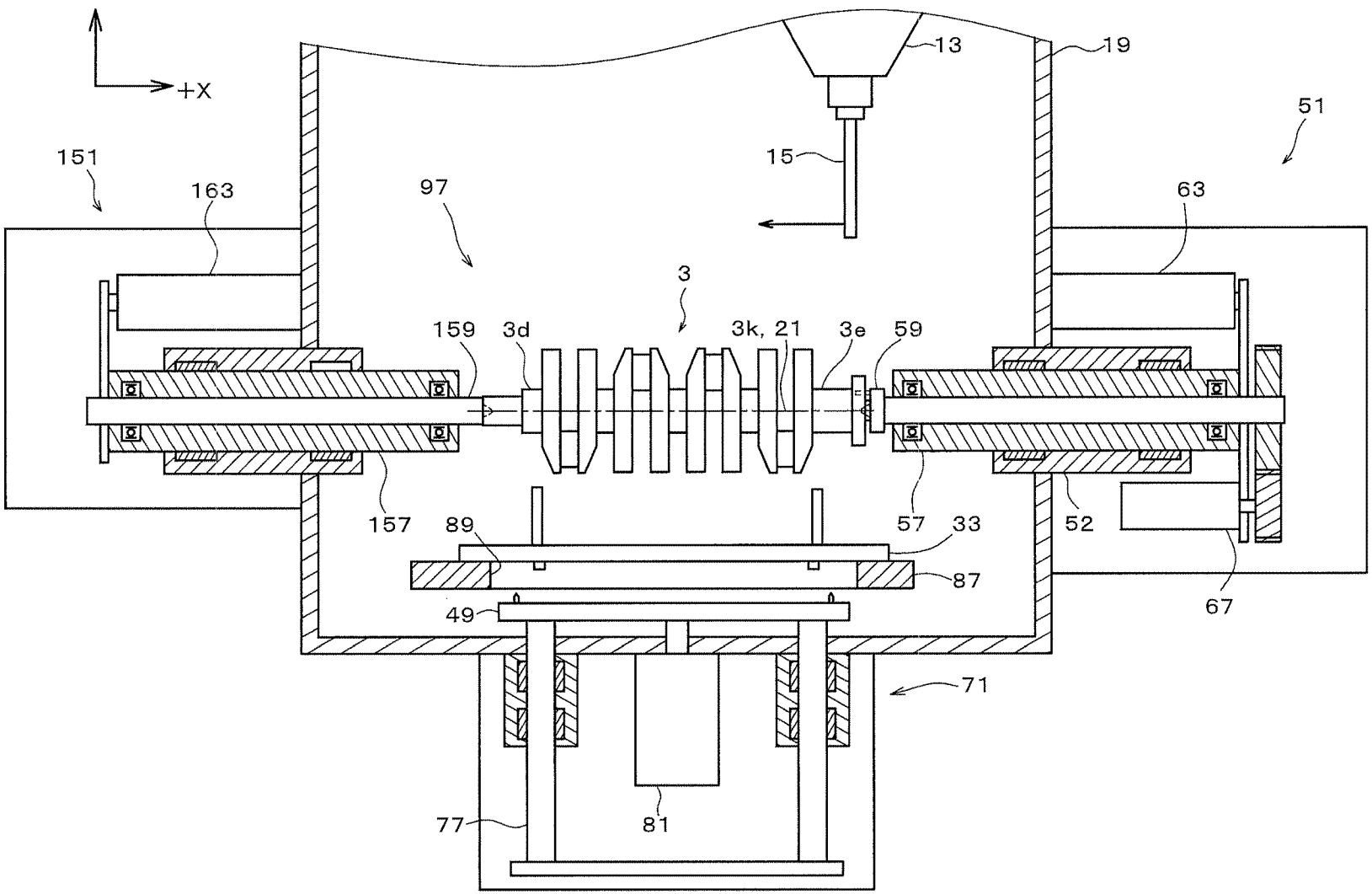
FIG. 7E is a cross-sectional view showing a state in which the table of the embodiment is retracted.

As shown in FIG. 7E, in step S14, the lifter 71 lowers the cleaning table 31 to the retracted position 24. At this time, the lifter 71 places the cleaning table 31 on the turn table 87.

Figure 7F:
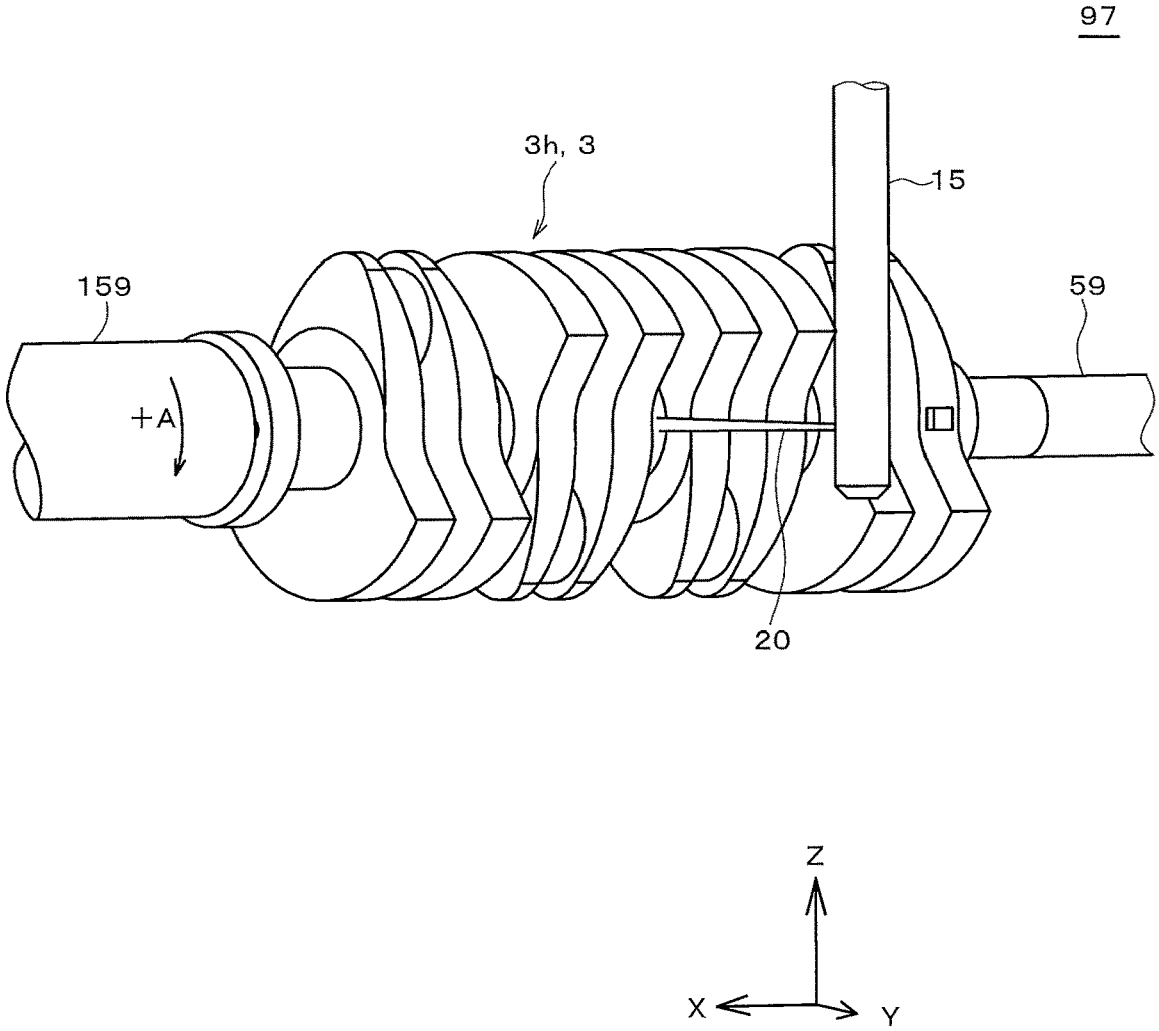
FIG. 7F is a perspective view showing a cleaning state of a shaft portion of the embodiment.

As shown in FIG. 7F, the moving device 14 moves the nozzles 15 to collide the jet 20 with the workpiece 3, and cleans the shaft portion 3*h*. At this time, the control device 25 appropriately rotates the workpiece 3, or positions the workpiece 3 in the rotational direction with the clamp shafts 59, 159 being together in step S15.

The lifter 71 raises the cleaning table 31 to the cleaning position in step S16.

The clamp cylinders 63, 163 retract the slide shafts 57, 157, respectively. The clamp shafts 59, 159 are spaced apart from the workpiece 3. In step S17, the workpiece 3 is unclamped and placed on the cleaning table 31.

Next, the procedure of drying, unloading, and loading in the drying station 95 will be described.

In step S11, the lifter 71 raises the cleaning table 31 to the drying position. The center axis 3*k* is aligned with the drying axis 121.

Next, in step S13, the clamping devices 51, 151 clamp the workpiece 3. In step S14, the lifter 71 is lowered, and the cleaning table 31 is placed on the turn table 87. The lifter 71 further lowers to the retracted position.

Figure 7G:
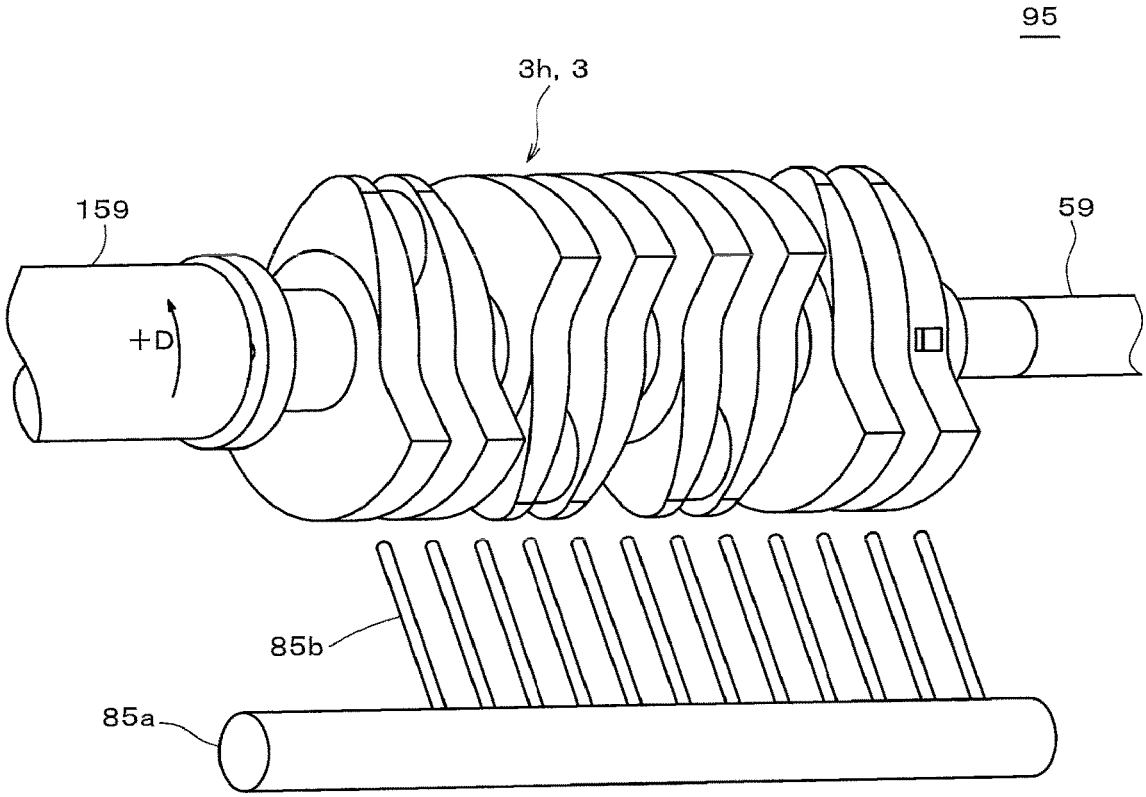
FIG. 7G is a perspective view showing a drying state of the embodiment.

Next, in step S25, the workpiece is air blown. As shown in FIG. 7G, the injection port of the air blowing nozzle 85*b* faces the workpiece 3. The air blowing nozzles 85*b* eject compressed air or dry air. The clamp shafts 59, 159 rotate the workpiece 3 as appropriate.

In step S16, the lifter 71 raises the cleaning table 31 to the drying position.

In step S17, the clamping devices 51, 151 unclamp the workpiece. The workpiece 3 is placed on the cleaning table 31.

In step S28, the loading shutter is opened.

The workpiece 3 in the drying station 95 is unloaded by a conveyance device (not shown) or by an operator. Next, the control device 25 controls the height of the cleaning table 31 based on the diameter of the journal of the workpiece 3.

Figure 7H:
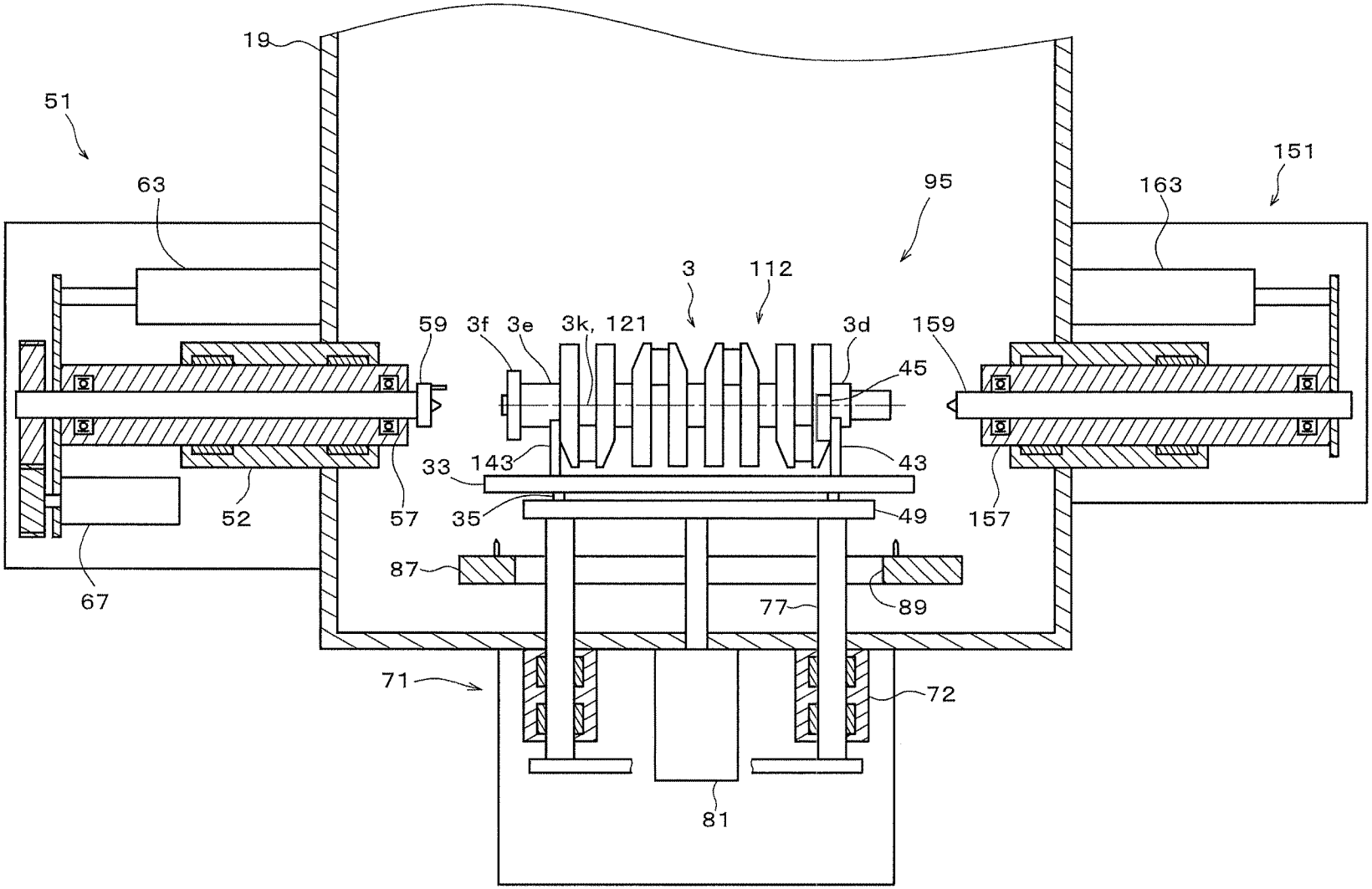
FIG. 7H is a cross-sectional view showing a loading state of the workpiece of the embodiment.

The workpiece 3 is loaded into the cleaning table 31 by the conveyance device (not shown) or the operator. FIG. 7H is a cross-sectional view of a perpendicular plane passing through the drying axis 121 as viewed from the front. In step S29, as shown in FIG. 7H, the journal 3*d* is aligned with the journal block 43, and the journal 3*e* is aligned with the journal block 143. The phasing surface 3*c* abuts the phasing surface 45*a*, and the phase of the workpiece 3 is matched with the cleaning table 31.

Finally, in step S30, the loading shutter is closed.

Steps S1 and S2 may be performed simultaneously. Step S4, step S11 at the cleaning station 97 and step S11 at the drying station 95 may be performed simultaneously. Step S16 and step S28 in the drying station 95 may be performed simultaneously. Steps S11, S13, S14, S25, S16, S17, and S28 to S29 in the drying station 95 are performed in parallel with steps S11 to S17 in the cleaning station 97.

According to the present embodiment, the workpiece 3 is clamped to the clamp shafts 59, 159 about the cleaning axis 21. The clamp shafts 59, 159 and the workpiece 3 rotate together. When cleaning or air blowing is performed, the cleaning table 31 is placed on the turn table 87 and is retracted downward. Therefore, the cleaning table 31 does not interfere with the cleaning or air blowing the shaft portion 3*h*. At the time of unclamping, since the end 3*g* is exposed, the nozzles 15 can clean the end 3*g*.

Since the lift cylinder 81 is a numerically controlled electric cylinder, the center axis 3*k* of the workpiece 3 having different diameters of the journals 3*d*, 3*e* can be aligned with the cleaning axis 21 or the drying axis 121. Since the clamp cylinders 63, 163 are numerically controlled electric cylinders, the clamp shafts 59, 159 can abut against the workpiece 3 having different lengths to clamp the workpiece 3 at a predetermined position.

Since the round pin 42 is disposed on the lift table 49 and the cylindrical hole 41 is disposed on the cleaning table 31, the lift table 49 can mount the cleaning table 31 at an accurate position.

Since the guide 39 guides the guide groove 37, it is possible to suppress the shift of the cleaning table 31 when the cleaning table 31 is moved up and down.

Since the round pin 47 is disposed on the turn table 87 and the cylindrical hole 48 is disposed on the cleaning table 31, the turn table 87 can mount the cleaning table 31 at an accurate position. Further, when the turn table 87 turns, the positional deviation of the cleaning table 31 can be suppressed.

Since the end 3*g* is cleaned while the workpiece 3 is installed on the cleaning table 31, and the workpiece 3 is clamped after the end 3*g* is cleaned, it is possible to suppress the clamp shafts 59, 159 from becoming dirty.

The workpiece 3 is cleaned while being sandwiched and supported by the clamp shafts 59, 159 through the cleaning axis 21. Since the cleaning table 31 is separated from the workpiece 3 when cleaning the shaft portion 3*h*, the nozzles 15 can easily approach the workpiece 3 and efficiently clean the workpiece 3. Since the workpiece 3 and the cleaning table 31 are separated from each other in the clamped state, and the workpiece 3 is rotated in a state in which the center axis 3*k* of the workpiece 3 and the cleaning axis 21 are aligned with each other, the inertia, can be reduced. It is substantially the same when drying.

Since the cleaning table 31 is separated from the workpiece 3 when the workpiece 3 is air blown, the air blowing nozzle 85*b* can approach the workpiece 3. Since the air blowing nozzle 85*b* and the workpiece 3 can approach each other, the blowing effect is enhanced.

The cleaning chamber 19 includes a cleaning station 97 and a drying station 95, and the turn table 87 turns to convey one workpiece 3 to the cleaning station 97 and another workpiece 3 to the drying station 95. While one workpiece 3 is cleaned in the cleaning station, another workpiece 3 which has been cleaned is air blown, the dried workpiece 3 is unloaded, and the workpiece 3 before cleaning is loaded. Therefore, the cycle time can be shortened.

The present invention is not limited to the embodiments described above, and various modifications can be made without departing from the gist of the present invention, and all technical matters included in the technical idea described in the claims are the subject matter of the present invention. While the foregoing embodiments illustrate preferred examples, those skilled in the art will appreciate that various alternatives, modifications, variations, or improvements may be made in light of the teachings disclosed herein and are within the scope of the appended claims.

REFERENCE SIGNS LIST

3 Workpiece
10 Cleaning apparatus
15 Nozzle (Cleaning nozzle)
21 Cleaning axis
31 Table (Cleaning table)
33 Top plate
49 Lift table
51 Clamping device (First clamping device)
57 Slide shaft (First slide shaft)
59 Clamp shaft (First clamp shaft)
63 Clamp cylinder (First clamp drive)
67 Motor
87 Turn table
151 Clamping device (Second clamping device)
157 Slide shaft (Second slide shaft)
159 Clamp shaft (Second clamp shaft)
163 Clamp cylinder (Second clamp drive)
71 Lifter

What is claimed is:

1. A cleaning apparatus for cleaning a workpiece, the cleaning apparatus comprising:

a cleaning chamber having a first side wall, and a second side wall opposed to the first side wall, the cleaning chamber including a cleaning station having a cleaning axis, the cleaning station being provided with a cleaning nozzle, the cleaning station including a first clamping device arranged on the second side wall, and a second clamping device arranged on the first side wall, a drying station having a drying axis, the drying station being provided with a drying nozzle, the drying station including the first clamping device arranged on the second side wall, and the second clamping device arranged on the first side wall;

a turn table having a first region and a second region arranged in a 180 degree rotational symmetry, the turn table configured to arrange the first region in the cleaning station and the second region in the drying station; and a cleaning table arranged in each of the first region and the second region, the cleaning table including a journal block;

wherein each of the cleaning station and the drying station includes a lifter having a lift table, the lifter is configured to move up and down between a cleaning position and a retracted position, the lift table moves up to support the cleaning table at the cleaning position, and the cleaning table is placed on the turn table to retract the lift table below the turn table at the retracted position, the first clamping device includes a first slide shaft configured to reciprocate along the cleaning axis or the drying axis, a first clamp shaft supported in the first slide shaft in a rotatable manner about the cleaning axis or the drying axis to abut the workpiece, a first clamp driving device configured to reciprocate the first slide shaft, and a motor configured to rotate the first clamp shaft, the second clamping device includes a second slide shaft configured to reciprocate along the cleaning axis or the drying axis, a second clamp shaft supported in the second slide shaft in a rotatable manner about the cleaning axis or the drying axis to abut the workpiece, and a second clamp driving device configured to reciprocate the second slide shaft.

2. The cleaning apparatus according to claim 1, further comprising:

a first inserting portion arranged on one of the cleaning table and the lift table; and a first receiving portion arranged on another of the cleaning table and the lift table, the first receiving portion configured to receive the first inserting portion.

3. The cleaning apparatus according to claim 1, wherein the turn table includes a passage opening formed to each of the first region and the second region, and the passage opening is located above the lift table when the first region and the second region are located in the cleaning station and the drying station.

4. The cleaning apparatus according to claim 1, further comprising:

a second insertion portion arranged on one of the cleaning table and the turn table; and a second receiving portion arranged on another of the cleaning table and the turn table, the second receiving portion configured to receive the second insertion portion.

5. The cleaning apparatus according to claim 1, wherein the lifter includes a lift guide arranged on the cleaning chamber, a stem connected to the lift table, the stem arranged through a bottom surface of the cleaning chamber, the stem configured to reciprocate along the lift guide together with the lift table, and a lift cylinder configured to drive the stem.

6. The cleaning apparatus according to claim 5, wherein the lift cylinder is a numerically controlled electric cylinder.

7. The cleaning apparatus according to claim 1, wherein the first clamping device includes a first guide bush having a hollow and arranged on the cleaning chamber along the cleaning axis or the drying axis, the first guide bush configured to slide the first slide shaft inside the first guide bush, the second clamping device includes a second guide bush having a hollow and arranged on the cleaning chamber along the cleaning axis or the drying axis, the second guide bush configured to slide the second slide shaft inside the second guide bush.

8. The cleaning apparatus according to claim 1, further comprising:

a moving device configured to move the cleaning nozzle with respect to the workpiece.

9. The cleaning apparatus according to claim 1, wherein each of the first clamp driving device and the second clamp driving device is a numerically controlled electric cylinder.

10. The cleaning apparatus according to claim 1, wherein the first clamp shaft is arranged through the first side wall of the cleaning station or the second side wall of the drying station, the motor is arranged outside the cleaning chamber, and the second clamp shaft is arranged through the second side wall of the cleaning station or the first side wall of the drying station.

11. The cleaning apparatus according to claim 2, wherein the turn table includes a passage opening formed to each of the first region and the second region, and the passage opening is located above the lift table when the first region and the second region are located in the cleaning station and the drying station.

12. The cleaning apparatus according to claim 2, further comprising:

a second insertion portion arranged on one of the cleaning table and the turn table; and a second receiving portion arranged on another of the cleaning table and the turn table, the second receiving portion configured to receive the second insertion portion.

13. The cleaning apparatus according to claim 3, further comprising:

a second insertion portion arranged on one of the cleaning table and the turn table; and a second receiving portion arranged on another of the cleaning table and the turn table, the second receiving portion configured to receive the second insertion portion.

14. The cleaning apparatus according to claim 2, wherein the lifter includes a lift guide arranged on the cleaning chamber, a stem connected to the lift table, the stem arranged through a bottom surface of the cleaning chamber, the stem configured to reciprocate along the lift guide together with the lift table, and a lift cylinder configured to drive the stem.

15. The cleaning apparatus according to claim 3, wherein the lifter includes a lift guide arranged on the cleaning chamber, a stem connected to the lift table, the stem arranged through a bottom surface of the cleaning chamber, the stem configured to reciprocate along the lift guide together with the lift table, and a lift cylinder configured to drive the stem.

16. The cleaning apparatus according to claim 4, wherein the lifter includes a lift guide arranged on the cleaning chamber, a stem connected to the lift table, the stem arranged through a bottom surface of the cleaning chamber, the stem configured to reciprocate along the lift guide together with the lift table, and a lift cylinder configured to drive the stem.

17. The cleaning apparatus according to claim 2, wherein the first clamping device includes a first guide bush having a hollow and arranged on the cleaning chamber along the cleaning axis or the drying axis, the first guide bush configured to slide the first slide shaft inside the first guide bush, the second clamping device includes a second guide bush having a hollow and arranged on the cleaning chamber along the cleaning axis or the drying axis, the second guide bush configured to slide the second slide shaft inside the second guide bush.

18. The cleaning apparatus according to claim 3, wherein the first clamping device includes a first guide bush having a hollow and arranged on the cleaning chamber along the cleaning axis or the drying axis, the first guide bush configured to slide the first slide shaft inside the first guide bush, the second clamping device includes a second guide bush having a hollow and arranged on the cleaning chamber along the cleaning axis or the drying axis, the second guide bush configured to slide the second slide shaft inside the second guide bush.

19. A cleaning method of axially extending workpiece, the cleaning method comprising:

loading the workpiece on a cleaning table;

lowering a lifter to place the cleaning table on a turn table;

turning the turn table to convey the workpiece from a drying station to a cleaning station, moving the cleaning table by the lifter to align a center axis of the workpiece with a cleaning axis in the cleaning station;

clamping the workpiece by abutting a first clamp shaft extending from a first side wall of a cleaning chamber against a first end of the workpiece, and by abutting a second clamp shaft extending from a second side wall of the cleaning chamber opposed to the first side wall against a second end of the workpiece;

lowering the lifter to place the cleaning table on the turn table;

cleaning an outer circumferential surface of the workpiece while rotating the workpiece, the first clamp shaft, and the second clamp shaft together;

moving the cleaning table to a cleaning position by the lifter;

unclamping the workpiece by separating the first clamp shaft from the first end of the workpiece, and by separating the second clamp shaft from the second end of the workpiece;

lowering the lifter to place the cleaning table on the turn table;

turning the turn table to convey the workpiece from the cleaning station to the drying station;

moving the cleaning table to a drying position by the lifter to align the center axis of the workpiece with a drying axis in the drying station;

clamping the workpiece by abutting the first clamp shaft extending from the second side wall of the cleaning chamber against the first end of the workpiece, and by abutting the second clamp shaft extending from the first side wall of the cleaning chamber against the second end of the workpiece;

lowering the lifter to place the cleaning table on the turn table;

drying the outer circumferential surface of the workpiece while rotating the workpiece, the first clamp shaft, and the second clamp shaft together;

moving the cleaning table to the drying position by the lifter;

unclamping the workpiece by separating the first clamp shaft from the first end of the workpiece, and by separating the second clamp shaft from the second end of the workpiece; and unloading the workpiece from the cleaning table.

20. The cleaning method according to claim 19, further comprising:

cleaning an end of the workpiece.

* * * * *